US006880625B2

(12) United States Patent
Choi et al.

(10) Patent No.: US 6,880,625 B2
(45) Date of Patent: Apr. 19, 2005

(54) CAPILLARY PUMPED LOOP SYSTEM

(75) Inventors: Mun-cheol Choi, Kyungki-do (KR); Byeoung Ju Ha, Kyungki-do (KR); Young-ki Hong, Kyungki-do (KR); Jong-beom Kim, Kyungki-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 31 days.

(21) Appl. No.: 10/108,549

(22) Filed: Mar. 29, 2002

(65) Prior Publication Data

US 2002/0139517 A1 Oct. 3, 2002

(30) Foreign Application Priority Data

Mar. 30, 2001 (KR) ..... 2001-16869
Mar. 2, 2002 (KR) ..... 2002-11182

(51) Int. Cl.[7] ..... F28D 15/00
(52) U.S. Cl. ..... 165/104.26; 165/104.21
(58) Field of Search ..... 165/104.21, 104.26, 165/104.33

(56) References Cited

U.S. PATENT DOCUMENTS 3,786,861 A * 1/1974 Eggers ..... 165/104.26
3,922,008 A * 11/1975 Stiner et al. ..... 165/104.26
4,116,266 A * 9/1978 Sawata et al. ..... 165/104.26
4,312,402 A * 1/1982 Basiulis ..... 165/104.26
4,370,547 A * 1/1983 Ward ..... 165/104.26
4,414,961 A * 11/1983 Luebke ..... 165/104.26
4,883,116 A * 11/1989 Seidenberg et al. .... 165/104.26
5,303,768 A * 4/1994 Alario et al. ..... 165/104.26
5,725,049 A * 3/1998 Swanson et al. ..... 165/104.26
6,523,259 B1 * 2/2003 Pinneo ..... 165/104.26

FOREIGN PATENT DOCUMENTS

JP 0001359 * 1/1978 ..... 165/104.26

* cited by examiner

*Primary Examiner*—Ljiljana Ciric
(74) *Attorney, Agent, or Firm*—Burns, Doane, Swecker & Mathis, L.L.P.

(57) ABSTRACT

A capillary pumped loop system includes an evaporator for vaporizing a refrigerant by absorbing heat from the periphery, a condenser for turning the vaporized refrigerant into a liquid by radiating heat from the vaporized refrigerant, a tube for forming a circulatory path connecting the evaporator to the condenser, and a capillary unit installed to form a plurality of gaps within the tube so that the refrigerant can move along the circulatory path due to capillary action caused by the gaps. Accordingly, when the refrigerant passes through the capillary unit due to the capillary action, bubbles in the tube can be reduced. In addition, a multi-path is formed for the movement of the liquid refrigerant, so discontinuation of the refrigerant can be prevented, thereby preventing the refrigerant in the evaporator from drying out.

11 Claims, 5 Drawing Sheets

CAPILLARY PUMPED LOOP SYSTEM

Priority is claimed to patent application No. 2001-16869 filed in Rep. of Korea on Mar. 30, 2001, and 2002-11182 filed in Rep. of Korean on Mar. 2, 2002, herein incorporated by reference.

BACKGROUND OF THE INVENTION

1. Field of the Invention

The present invention relates to a capillary pumped loop (CPL) system having a structure in which a refrigerant is circulated by capillary action.

2. Description of the Related Art

Recently, as the ongoing development of electronic technology has led to the miniaturization and increase of the output power of electronic equipment, a ratio of heat radiation per unit area in the electronic equipment has increased. Accordingly, performance of appropriately controlling heat generated from such electronic equipment has become an important factor which should be considered during design and operation.

To efficiently control heat, there has been proposed a CPL system having a structure in which a refrigerant is circulated by capillary action. Since the CPL system can perform heat exchange by circulating a refrigerant without a separate driving unit, the CPL system is recognized as being suitable to recently developed light weight miniaturized electronic equipment.

FIG. 1 shows the structure of a conventional CPL system. Referring to FIG. 1, an evaporator 2 for vaporizing a refrigerant by absorbing heat from the periphery is connected to a condenser 3 for condensing a refrigerant by radiating heat from a tube 1, thereby forming a circulatory path. The condenser 3 is a portion of the tube 1 and is a condensing region in which a refrigerant is condensed into a liquid. A porous body 2*b* is installed to be connected to the tube 1 within a case 2*a* to which heat is transmitted from the outside of the evaporator 2. A refrigerant 4 flowing into the evaporator 2 through the tube 1 is absorbed into pores of the porous body 2*b* by capillary action and sucked toward the outer perimeter. The refrigerant 4 then absorbs external heat transmitted through the case 2*a* and is vaporized. The vaporized refrigerant comes out of the evaporator 2 and moves to the condenser 3 through the tube 1. The vaporized refrigerant radiates enough heat to be liquefied in the condenser 3. Thereafter, the refrigerant in a liquid state moves through the tube 1 and flows into the evaporator 2.

However, while a refrigerant moves from the output port of the condenser 3 to the input port of the evaporator 2, bubbles 5 may be formed in the tube 1. The bubbles 5 hinder the progress of the refrigerant. Accordingly, it is preferable to reduce the bubbles 5, but the conventional CPL system does not have an expedient for reducing the bubbles 5. Therefore, a CPL system having an improved structure for solving the above problem is desired.

SUMMARY OF THE INVENTION

To solve the above problem, it is an object of the present invention to provide an improved capillary pumped loop (CPL) system having reliable performance by reducing bubbles in a liquid refrigerant to prevent drying out.

To achieve the above object of the invention, there is provided a CPL system including an evaporator for vaporizing a refrigerant by absorbing heat from the periphery, a condenser for turning the vaporized refrigerant into a liquid by radiating heat from the vaporized refrigerant, a tube for forming a circulatory path connecting the evaporator to the condenser, and a capillary unit for forming a plurality of gaps within the tube from the condenser to the evaporator so that the refrigerant can move along the circulatory path due to capillary action caused by the gaps.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
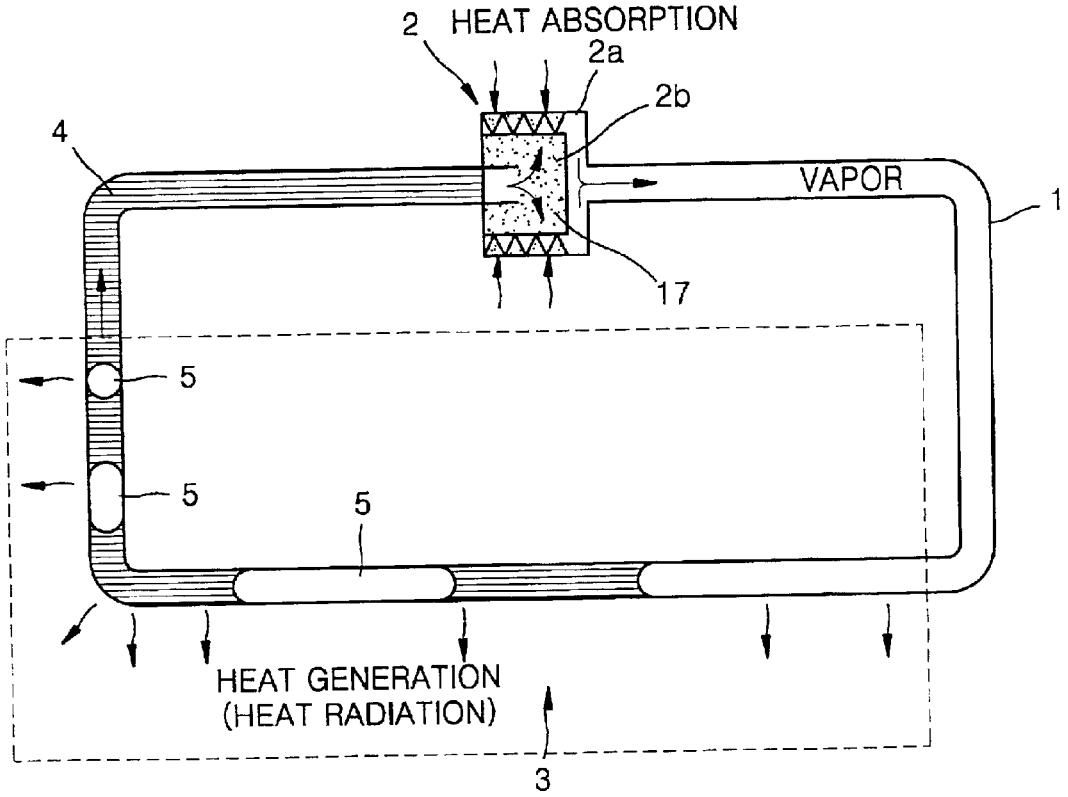
FIG. 1 (PRIOR ART)
FIG. 1 is a schematic diagram of a conventional capillary pumped loop (CPL) system.
Figure 2:
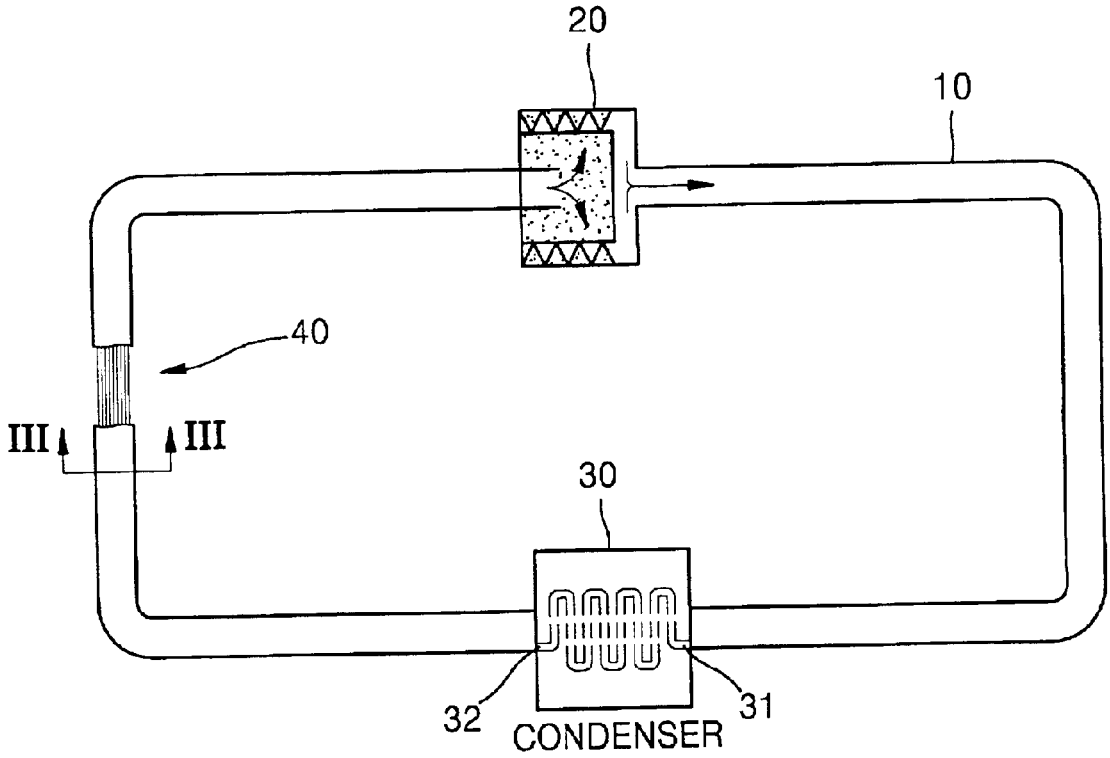
FIG. 2 is a diagram of a CPL system according to the present invention.
Figure 3:
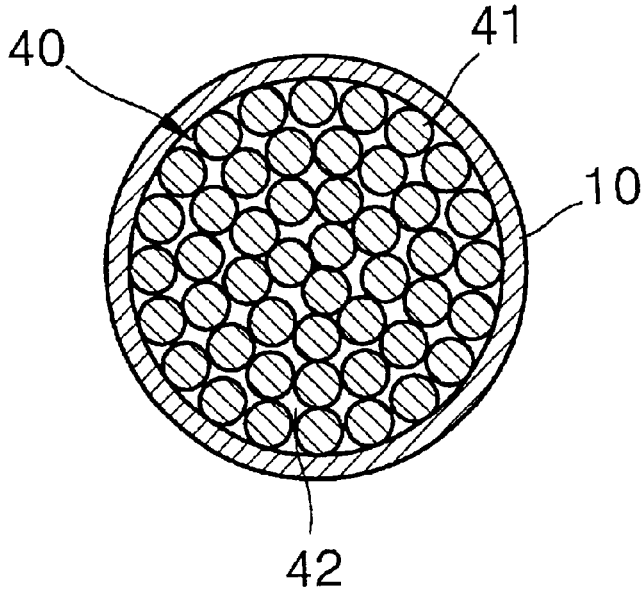
FIG. 3 is a sectional view of the CPL system of FIG. 2, taken along the line III—III.

Referring to FIGS. 2 and 3, a capillary pumped loop (CPL) system according to the present invention includes an evaporator 20 for vaporizing a refrigerant (not shown) by absorbing from the periphery, a condenser 30 for turning a vaporized refrigerant into a liquid by radiating heat from the refrigerant, and a tube 10 connecting the evaporator to the condenser 30 to form a circulatory path through its hollow inside. In addition, a wire bunch 40 composed of a plurality of wires 41 is installed in the tube 10 in which a liquid refrigerant moves from the condenser 30 to the evaporator 20. The wire bunch 40 is provided for inducing the circulation of a refrigerant due to capillary action. As shown in FIG. 3, gaps 42 for inducing capillary action are formed between the wires 41, so a refrigerant is sucked into the gaps 42 and progresses through the tube 10.

In such a structure, a refrigerant turned into a liquid by the condenser 30 moves to the evaporator 20 through the tube 10. When the liquid refrigerant is sucked into the evaporator 20 due to a fine structure (a porous structure) within the evaporator 20, a pressure at the output port of the condenser 30 is lower than a pressure at the input port of the condenser 30. Due to such a difference in pressure, a refrigerant vaporized by the evaporator 20 moves to the condenser 30.

The wire bunch 40 reduces bubbles in a liquid refrigerant. In other words, a bubble in a refrigerant turned into a liquid by the condenser 30 is broken into pieces and almost disappears while it is passing through the gaps 42 in the wire bunch 40. Accordingly, a problem of bubbles hindering the progress of a refrigerant in the tube 10 can be solved.

Figure 4:
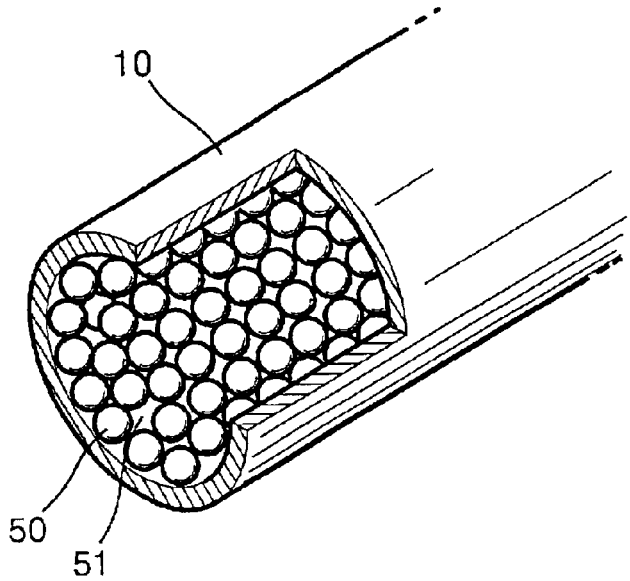
FIGS. 4 through 7 are diagrams of examples of a modification to the CPL system of FIG. 2.

Meanwhile, in the above embodiment of the present invention, the wire bunch 40 is used as a capillary unit for forming a plurality of small gaps within the tube 10, but as shown in FIG. 4, the tube 10 can alternatively be filled with grains 50 such as metal beads. Similarly, a refrigerant is sucked into the gaps 51 formed between the grains 50 to thus progress through the tube 10. Here, an effect of reducing bubbles passing through the gaps 51 is the same as described above.

Figure 5:
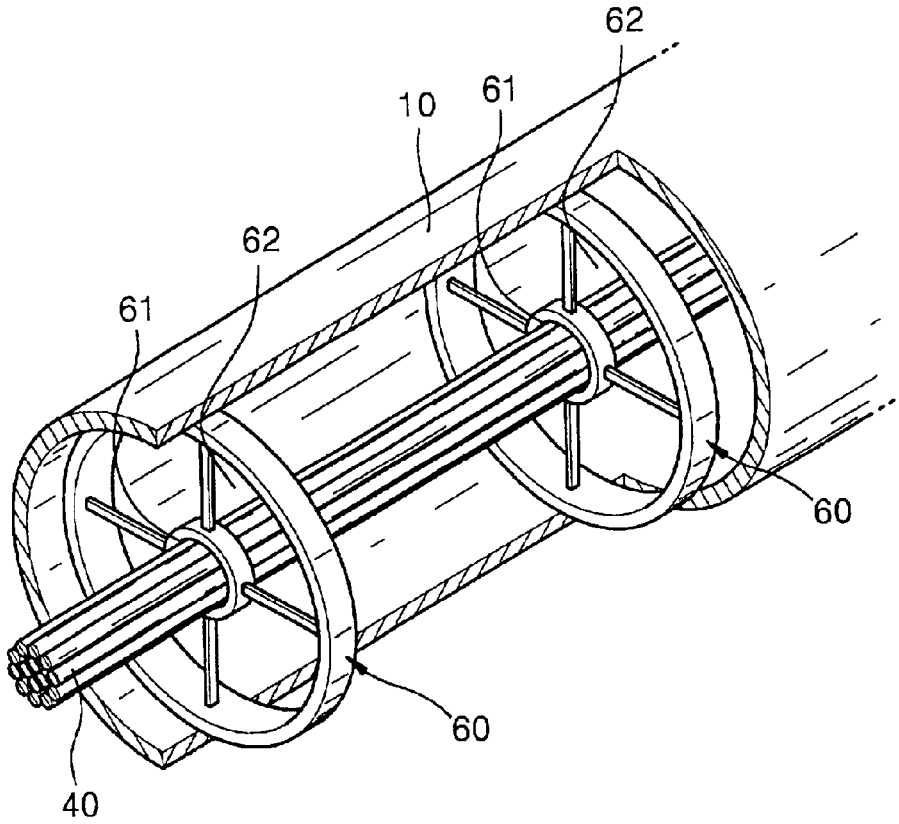
Figure 6A:
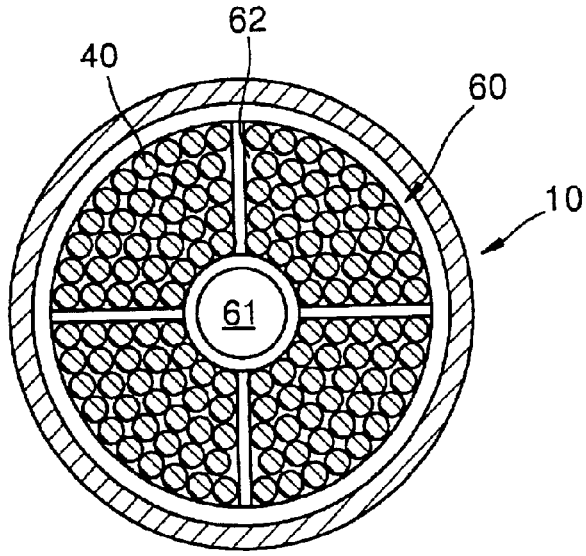
Figure 6B:
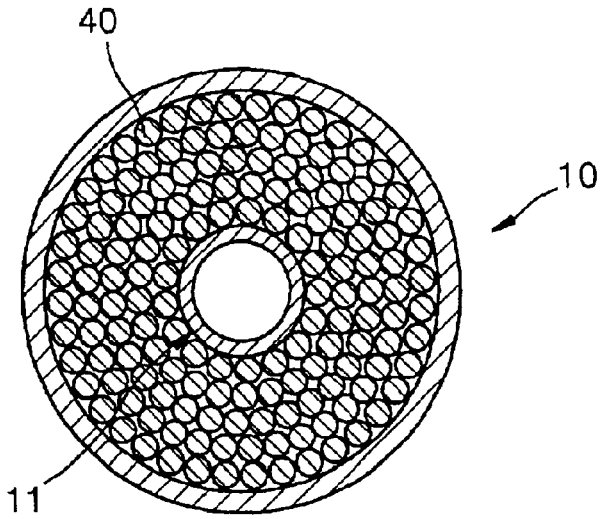
Figure 7:
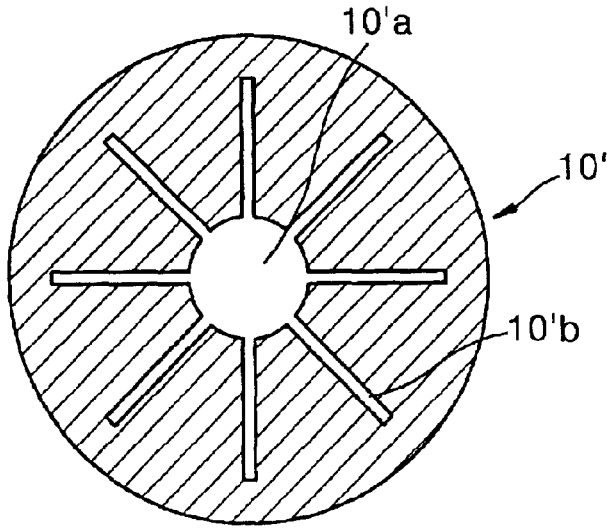

According to the present invention, capillary units having other modified forms can be applied, as shown in FIGS. 5 through 7. Considering a problem in that the flow of a refrigerant can be slowed when the tube 10 is filled with the wire bunch 40 or the grains 50, as shown in FIGS. 3 or 4, to form gaps, the tube 10 is partially filled to secure a space allowing the refrigerant to smoothly flow through the tube 10 in FIGS. 5 through 7.

In FIG. 5, holders 60 each including a central hole 61 and outer holes 62 are installed within the tube 10 at predetermined intervals, and the wire bunch 40 is disposed to pass through and be supported by the central holes 61 of the holders 60. Accordingly, the wire bunch 40 is compact only at the central portion of the tube 10, and a space is formed between the inner wall of the tube 10 and the central portion thereof, thereby not only removing bubbles due to the wire bunch 40 but also allowing a refrigerant to smoothly flow through the space.

In contrast to FIG. 5, in FIG. 6A, the wire bunch 40 is disposed to pass through the outer holes 62 of the holders 60, and the central holes 61 remain blank. Accordingly, the wire bunch 40 is compact only a portion near around the inner wall of the tube 10, and a space is formed at the central portion of the tube 10. The disposition in FIG. 6A is opposite to FIG. 5, but the effect of the capillary unit in FIG. 6A is the same as in FIG. 5. Similarly, in FIG. 6B, a small tube 11 having the wire bunch 40 wrapped or attached around its outer side can be installed within the tube 10.

In FIG. 7, instead of filling a tube 10' with the wire bunch 40 or the grains 50, a plurality of grooves 10'*b* are formed in the inner wall of the tube 10' along a path through which a refrigerant flows. In this case, not only a refrigerant can smoothly flow through a central hole 10'*a* of the tube 10' but also bubbles can be removed when the refrigerant passes through the narrow grooves 10'*b*. In addition, since it is not necessary to install separate members, the capillary unit can be easily formed.

By installing a capillary unit which can be modified in various ways in a tube, a refrigerant can be circulated by capillary action, and a high cooling effect and bubble reducing effect can be achieved. The present invention can be properly used as a cooling apparatus for small parts of electronic products, for example, a central processing unit (CPU) of a computer.

As described above, a CPL system according to the present invention is provided with a capillary unit for inducing capillary action within a tube, thereby reducing bubbles within the tube.

What is claimed is:

1. A capillary pumped loop system comprising:

an evaporator for vaporizing a refrigerant by absorbing heat from the periphery;

a condenser for turning the vaporized refrigerant into a liquid by radiating heat from the vaporized refrigerant;

a tube forming a loop connecting the evaporator to the condenser for circulating the refrigerant therebetween; and capillary action means for reducing bubble formation in the liquid refrigerant flowing within the tube so that the refrigerant can move in one direction, around the loop formed by the tube, due to capillary action.

2. The capillary pumped loop system of claim 1, wherein the capillary action means is installed in a portion of the tube in which the refrigerant moves from the condenser to the evaporator.

3. The capillary pumped loop system of claim 1, wherein the capillary action means comprises a bunch of wires.

4. The capillary pumped loop system of claim 3, wherein the tube is uniformly filled with the bunch of wires throughout its inner hollow.

5. The capillary pumped loop system of claim 3, wherein the bunch of wires are compact only at a central portion of the tube so that a space can be formed between the inner wall of the tube and the central portion thereof.

6. The capillary pumped loop system of claim 3, wherein the bunch of wires are compact only near around the inner wall of the tube so that a space can be formed in central portion of the tube.

7. The capillary pumped loop system of claim 1, wherein the capillary action means comprises a plurality of grains.

8. The capillary pumped loop system of claim 1, wherein the capillary action means comprises a plurality of grooves formed in the inner wall of the tube along a path through which the refrigerant flows.

9. The capillary pumped loop system of claim 2, wherein the capillary action means comprises a plurality of grains.

10. The capillary pumped loop system of claim 2, wherein the capillary action means comprises a plurality of grooves formed in the inner wall of the tube along a path through which the refrigerant flows.

11. The capillary pumped loop system of claim 1, wherein all boundaries of the loop are defined by the tube.

* * * * *